US005414229A

United States Patent [19]

Rocheleau et al.

[11] Patent Number: 5,414,229

[45] Date of Patent: May 9, 1995

[54] MOLDED BRACKET FOR MOUNTING A SPEAKER IN A VEHICLE

[75] Inventors: Paula M. Rocheleau, Utica; James M. Wojciechowski, Davisburg; Donald E. Miller, Livonia; Eric S. Mozer, Rochester; Lisa Alcini-Mazur, Washington, all of Mich.

[73] Assignee: Chrysler Corporation, Highland Park, Mich.

[21] Appl. No.: 192,887

[22] Filed: Feb. 7, 1994

[51] Int. Cl.[6] ..... H04R 7/20

[52] U.S. Cl. ..... 181/150; 181/141; 181/153; 181/199; 381/188; 248/27.1

[58] Field of Search ..... 181/150, 141, 153, 199; 381/188; 248/27.1

[56] References Cited

U.S. PATENT DOCUMENTS 4,546,850 10/1985 Litner ..... 181/141

4,633,972 1/1987 DeRocher ..... 181/150 X

*Primary Examiner*—M. L. Gellner

*Assistant Examiner*—Daniel P. Malley

*Attorney, Agent, or Firm*—Christopher A. Taravella

[57] ABSTRACT

For use in mounting a speaker on a wall member, such as a rear corner pillar, of a vehicle, such as a van, mini-van, or station wagon, a molded speaker mounting bracket adapted to being speaker mounted on the pillar. The molded bracket includes speaker receiving segment and three legs extending from the receiving segment for being heat welded onto a surface of the corner pillar. The speaker receiving segment is contoured to include a first square portion, a second frustoconical portion, and a third internal flange portion, with an upwardly converging open front terminating in upper corners positioned a predetermined distance apart, adapted to having a speaker snapped past the upper corners by spreading same and thereafter being securely retained by the first, second and third contoured portions.

8 Claims, 3 Drawing Sheets

FIG. 3
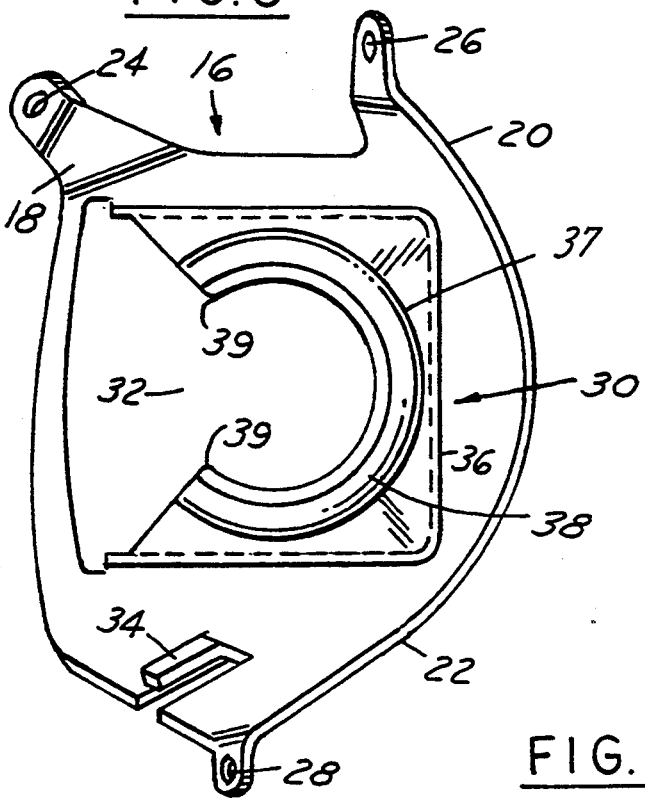
FIG. 7
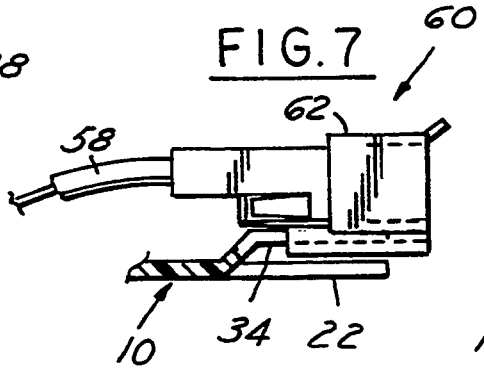
FIG. 8
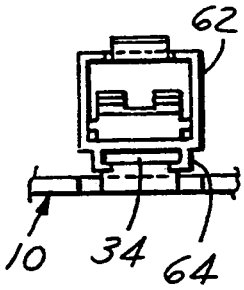
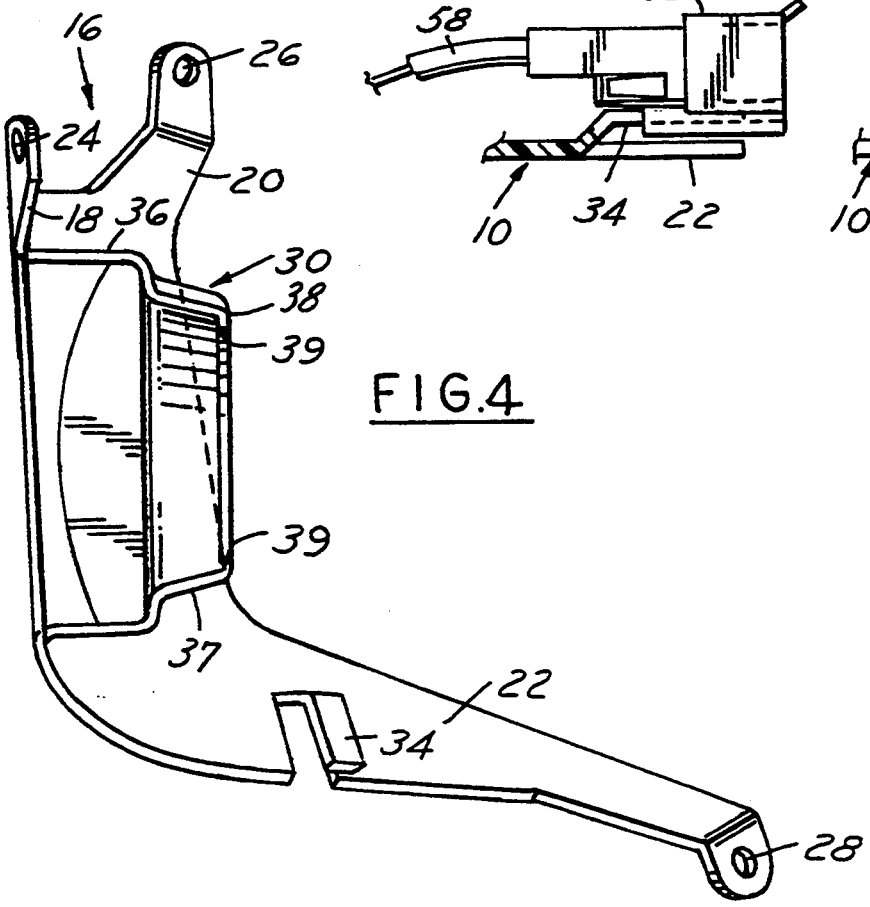
FIG. 4

FIG. 5
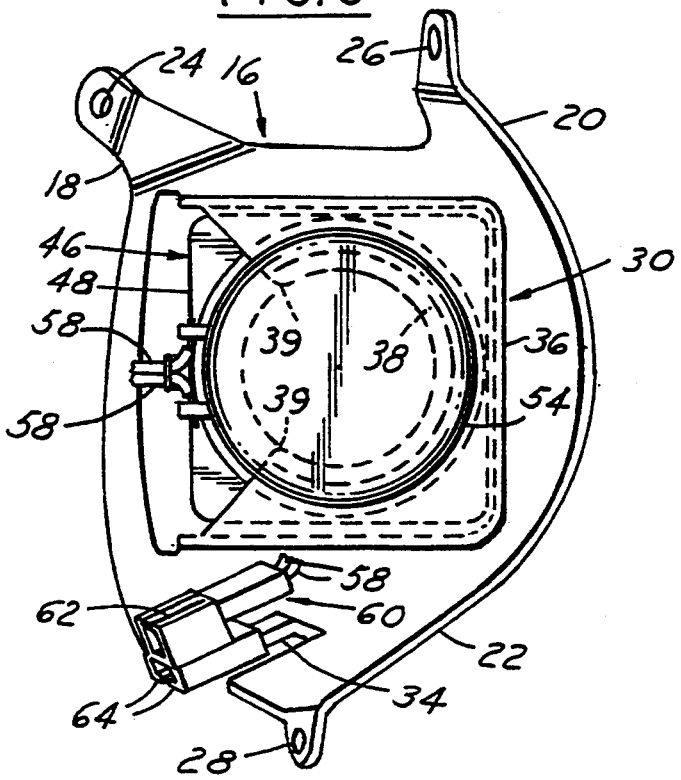
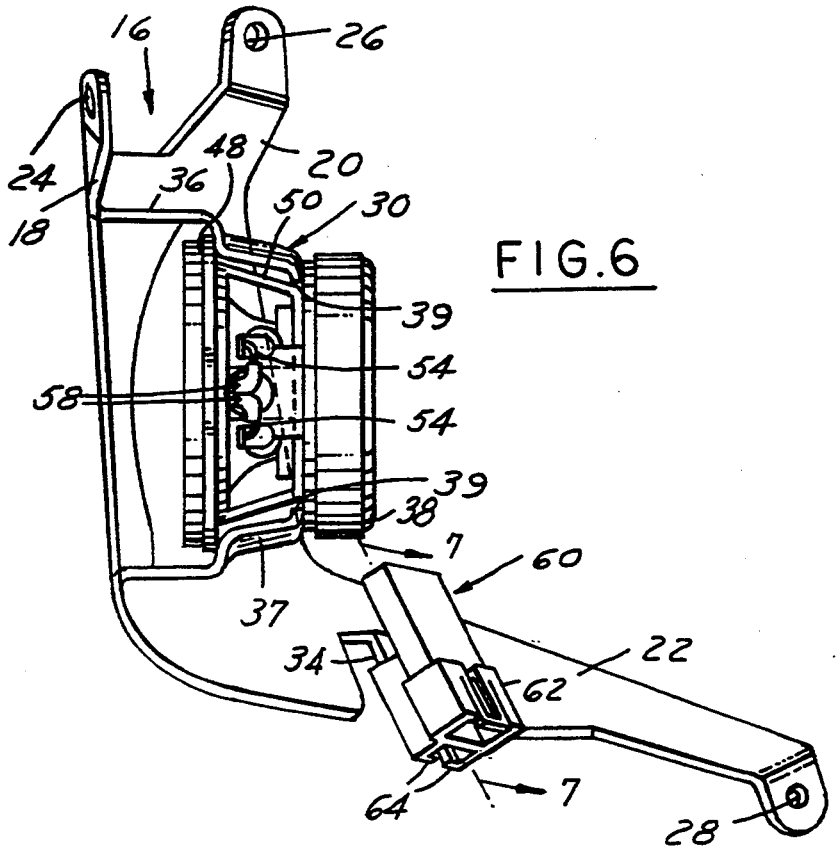
FIG. 6

MOLDED BRACKET FOR MOUNTING A SPEAKER IN A VEHICLE

TECHNICAL FIELD

This invention relates generally to molded mounting brackets and, more specifically, to a molded mounting bracket for mounting a speaker on a pillar of a vehicle.

BACKGROUND ART

Heretofor, speakers have generally been mounted in various locations within the walls of vehicles by threaded fasteners or by specially shaped clips, such as by threadedly mounted, oppositely disposed, resilient Z-shaped clips shown and idescribed in Litner U.S. Pat. No. 4,546,850.

DISCLOSURE OF THE INVENTION

A general object of the invention is to provide an improved speaker mounting bracket for vehicles.

Another object of the invention is to provide a molded speaker mounting bracket wherein the speaker may be manually snapped into a secure holding position in the bracket.

A further object of the invention is to provide a molded speaker mounting bracket having a contoured speaker receiving segment including a first square portion, a second frustoconical portion and a third internal flange portion, with an open side being cut out of each of these portions for approximately one-fourth of the peripheral surfaces thereof, with the internal flange having terminal corners positioned a predetermined distance apart and adapted to being spread while a speaker is manually pushed or snapped therepast into a final secure holding position in the first, second and third portions.

These and other objects and advantages will become more apparent when reference is made to the following drawings and the accompanying description.

BRIEF DESCRIPTION OF THE DRAWINGS

FIG. 3 and 4 are respective top and side views of the speaker mounting bracket of FIG. 2;

FIGS. 5 and 6 are respective top and side views similar to FIGS. 3 and 4, and having a speaker mounted thereon;

FIG. 7 is a cross-sectional view taken along the plane of the line 7—7 of FIG. 6, and looking in the direction of the arrows; and FIG. 8 is an end view taken along the plane of the line 8—8 of FIG. 7, and looking in the direction of the arrows.

BEST MODE OF CARRYING OUT THE INVENTION

Figure 1:
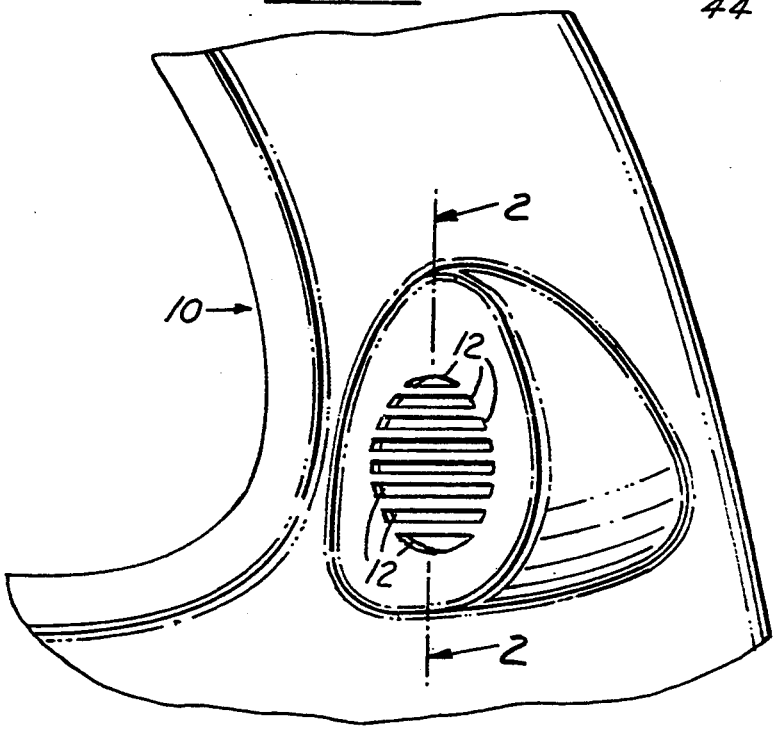
FIG. 1 is a fragmentary perspective view of a vehicle pillar adaptable to having a speaker mounting bracket heat welded thereto for receiving a speaker.

Referring now to the drawings in greater detail, FIG. 1 illustrates a portion of a corner pillar 10, i.e., the rear corner pillar of a minivan, for example, having slotted openings 12 formed in a contoured portion 14 thereof. The contoured portion 14 is adapted to having a speaker positioned therebehind, as will be explained.

Figure 2:
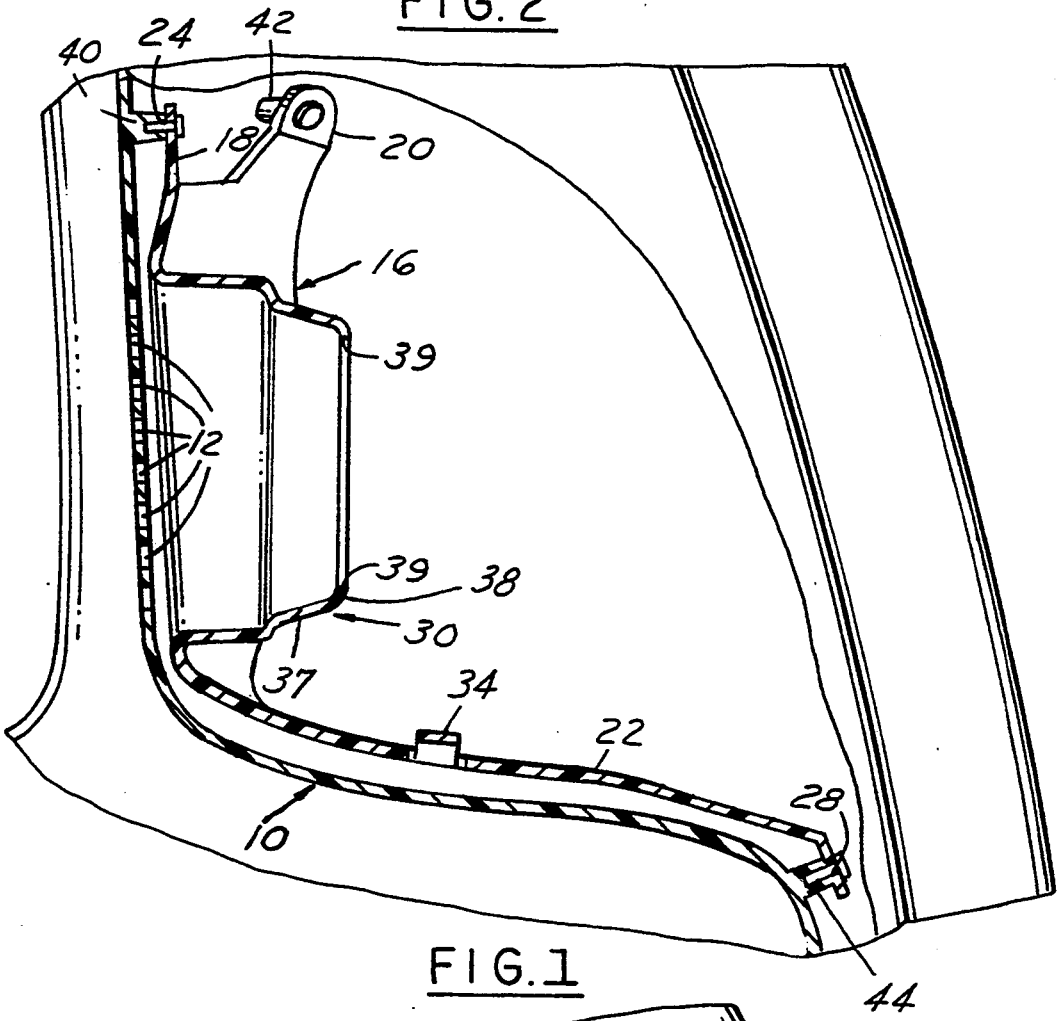
FIG. 2 is a fragmentary cross-sectional view of a speaker mounting bracket mounted on a surface of the pillar of FIG. 1.

As shown in FIG. 2, a molded speaker mounting bracket 16 is mounted in the contoured portion 14. Specifically, as shown in FIGS. 3 and 4, the speaker mounting bracket 16 is molded to include three leg extensions 18, 20 and 22 having holes 24, 26 and 28 formed adjacent the respective distal ends thereof; a centrally located speaker receiving segment 30 with one open side 32 formed therein; and an electrical connector mounting tab 34 formed along an edge of the longest leg extension 22. The speaker receiving segment 30 is molded to include a first square portion 36, a second frustoconical portion 37, and a third internal flange portion 38, with the open side 32 being cut out of each of these portions for approximately one-fourth of the peripheral surfaces thereof, with the internal flange 38 having terminal corners 39 positioned a predetermined distance apart.

As noted in FIG. 1, the holes 24, 26 and 28 are aligned with respective pedestals 40, 42 and 44 formed on the inner surface of each corner pillar 10, and heat welded in place in any suitable manner.

As shown in FIGS. 5 and 6, a speaker 46 includes a square metal base 48, a center open-sided enclosure 50, a neck 52, and an enclosed disk-shaped top 54. A pair of terminals 56 extend from the front of the open-sided enclosure 50. A pair of leads 58 extend from the pair of terminals 56 to a connector 60. The connector 60 is mounted on the mounting tab 34.

As shown in FIGS. 7 and 8, the connector 60 includes a body portion 62 and oppositely disposed mounting flanges 64 formed on the bottom surface 66 of the body portion 62. The flanges 64 are adapted to slidably mount around the mounting tab 34.

At assembly, the speaker 46 is readily mountable in the bracket 16 by placing the neck 52 against the corners 39 and pushing the speaker therepast in a snap-in type action. The predetermined spacing between the corners 39 is such that the corners are spread further apart until the neck 52 of the bracket 16 passes by and the bracket 16 snaps into place, contained by the other approximately three-fourths of the respective square, frustoconical, and internal flange portions 36, 37, and 38 of the receiving segment 30, with the corners 39 returning to their free position.

As indicated above, the connector 60 is readily mounted in place by sliding the flanges 64 onto the mounting tab 34.

INDUSTRIAL APPLICABILITY

It should be apparent that the invention provides an improved, molded speaker bracket, which is readily mountable on suitable wall members, such as the rear corner pillar of a vehicle, such as a van, minivan, or station wagon.

It should also be apparent that the speaker is readily, quickly and securely mountable in the speaker bracket.

It should be further apparent that the speaker mounting brackets may comprise right and left hand units for the oppositely disposed rear corner pillars.

While but one embodiment of the invention has been shown and described, other modifications thereof are possible within the scope of the following claims.

What is claimed is:

1. A molded speaker mounting bracket for use in mounting a speaker on a wall member of a vehicle, the molded bracket comprising a speaker receiving segment and three leg extensions from the receiving segment for mounting on the wall member, the speaker receiving segment being contoured and having an open front with converging sides terminating in corners positioned a predetermined distance apart, and a round open top extending from corner to corner adapted to having a speaker inserted into said round open top past the corners by spreading the corners while passing same and thereafter being retained in the round open top.

2. The molded bracket described in claim 1, wherein said wall member is a rear corner pillar.

3. The molded bracket described in claim 1, wherein said mounting bracket is heat welded to the wall member.

4. The molded bracket described in claim 1, wherein the contoured speaker receiving segment comprises a first square portion, a second frustoconical portion connected to said first portion, and a third internal flange portion connected to said second portion defining said round open top and said corners.

5. The molded bracket described in claim 4, wherein said open front comprises approximately one-fourth of said square, frustoconical, and internal flange portions.

6. The molded bracket described in claim 5, and a speaker, wherein said speaker includes a square base fitted through said open front into said first square portion, a frustoconical segment including a pair of terminals and fitted through said open front into said second frustoconical portion, a necked-in segment snapped past said corners into said third internal flange portion, and a round disk-like top segment mounted outward of said internal flange.

7. The molded bracket described in claim 6, and a tab integrally molded said bracket and having an electrical connector slidably mounted thereon, said connector having a pair of leads extending therefrom to said pair of terminals mounted in said frustoconical segment.

8. The molded speaker mounting bracket described in claim 1, wherein said contoured speaker receiving segment includes a first square portion, a second frustoconical portion connected to said first portion, and a third internal flange portion connected to said second portion, said open side converging from said first portion to said third portion and having terminal ends at said third portion which are a predetermined distance apart, and said one open side comprises approximately one-fourth of each of the first, second and third portions, and said terminal ends adapted to being spread while snapping in said speaker through said open side into said first, second and third portions.

* * * * *